US005150740A

United States Patent [19]

Yun

[11] Patent Number: 5,150,740

[45] Date of Patent: Sep. 29, 1992

[54] FILLING VALVE

[75] Inventor: Chung J. Yun, Baltimore, Md.

[73] Assignee: Crown Cork & Seal Company, Inc., Philadelphia, Pa.

[21] Appl. No.: 595,966

[22] Filed: Oct. 11, 1990

Related U.S. Application Data

[62] Division of Ser. No. 420,575, Oct. 12, 1989, abandoned.

[51] Int. Cl.[5] ..... B67C 3/02

[52] U.S. Cl. ..... 141/6; 141/40; 141/46; 141/57

[58] Field of Search ..... 141/6, 7, 39, 40, 44-47, 141/49-51, 54-59, 260, 263, 264, 301-303, 307-310

[56] References Cited

U.S. PATENT DOCUMENTS

| | | | |
|---|---|---|---|
| 2,202,033 | 5/1940 | Stewart et al. | 141/148 |
| 2,239,385 | 4/1941 | Harder | 141/148 |
| 2,663,479 | 12/1953 | Detrez | 226/98 |
| 2,676,742 | 4/1954 | Day et al. | 141/39 |
| 2,770,263 | 11/1956 | Breeback | 141/6 |
| 2,794,455 | 6/1957 | Day et al. | 141/234 |
| 3,090,408 | 5/1963 | Naecker | 141/57 |
| 3,211,192 | 10/1965 | van Zyl | 141/57 X |
| 3,478,785 | 11/1969 | Mallrich et al. | 141/39 |
| 3,516,455 | 6/1970 | Carter | 141/150 |
| 3,519,035 | 7/1970 | Remane | 141/187 |
| 3,580,988 | 5/1979 | Orlowski et al. | 16/2 |
| 3,586,066 | 6/1971 | Brown | 141/5 |
| 3,626,996 | 12/1971 | Bingham et al. | 141/5 |
| 3,637,222 | 1/1972 | Wilkinson | 277/34 |

(List continued on next page.)

FOREIGN PATENT DOCUMENTS

| | | | |
|---|---|---|---|
| 18495 | 12/1904 | Austria . | |
| 620420 | 11/1962 | Belgium . | |
| 080774 | 6/1983 | European Pat. Off. . | |
| 2838244 | 3/1979 | Fed. Rep. of Germany | 141/57 |
| 3319040 | 11/1984 | Fed. Rep. of Germany . | |
| 1016065 | 11/1952 | France . | |
| 1180592 | 6/1959 | France . | |
| 281533 | 12/1927 | United Kingdom . | |
| 665635 | 1/1952 | United Kingdom . | |
| 777929 | 7/1957 | United Kingdom . | |
| 0926991 | 5/1963 | United Kingdom | 141/57 |
| 983326 | 2/1965 | United Kingdom . | |
| 1359496 | 7/1974 | United Kingdom . | |

OTHER PUBLICATIONS

"Uni-Blend—Soft Drink Can Filling Equipment," Crown Cork & Seal Company, Inc.

*Primary Examiner*—Henry J. Recla
*Assistant Examiner*—Casey Jacyna
*Attorney, Agent, or Firm*—Woodcock Washburn Kurtz Mackiewicz & Norris

[57] ABSTRACT

Filling valves for counterpressure filling of containers with carbonated liquids. The filling valves comprise valve bodies for conducting the carbonated liquids to the container from an external reservoir, the valve body having an end from which the carbonated liquid is dispensed to the container. The valves further comprise counterpressure valves movably mounted in the valve body for controlling the flow of counterpressure gas to the containers. Vent tubes mounted in the valve bodies through the dispensing end of the valve bodies, the vent tubes being slidable with respect to the valve bodies from a retracted position to an extended position in the containers in response to the counterpressure gas are provided. Pressure relief passages interfaced through the valve bodies for venting gas from the valves after the liquid has filled the containers whereby movement of the vent tubes from the extended position to the retracted position is substantially unimpeded are further provided. Housings movably mounted with respect to the valve bodies for securing the containers to the valves during filling and actuating cams coupled thereto for moving the housings relative to the valve bodies onto the containers are further provided in accordance with the invention.

4 Claims, 5 Drawing Sheets 3,683,976 8/1972 Remane ..... 141/287
3,807,463 4/1974 Rademacher et al. ..... 141/104
3,830,265 8/1974 Matejek ..... 141/6
3,834,428 10/1974 Rademacher ..... 141/39
3,845,791 11/1974 Friendship ..... 141/6
3,908,717 9/1975 Rademacher et al. ..... 141/52
4,089,353 5/1978 Antonelli ..... 141/302
4,124,043 11/1978 Noguchi ..... 141/6
4,206,789 6/1980 Jordan et al. ..... 141/39
4,349,055 9/1982 DiChiara ..... 141/39
4,387,748 6/1983 White ..... 141/57
4,442,873 4/1984 Yun ..... 141/39
4,534,569 8/1985 Ishitani et al. ..... 277/34
4,586,548 5/1986 Hinxlage ..... 141/57
4,688,608 8/1987 Puskarz et al. ..... 141/39
4,750,533 6/1988 Yun ..... 141/46
4,938,261 7/1990 Petri et al. ..... 141/39
4,989,650 2/1991 Weiss ..... 141/6

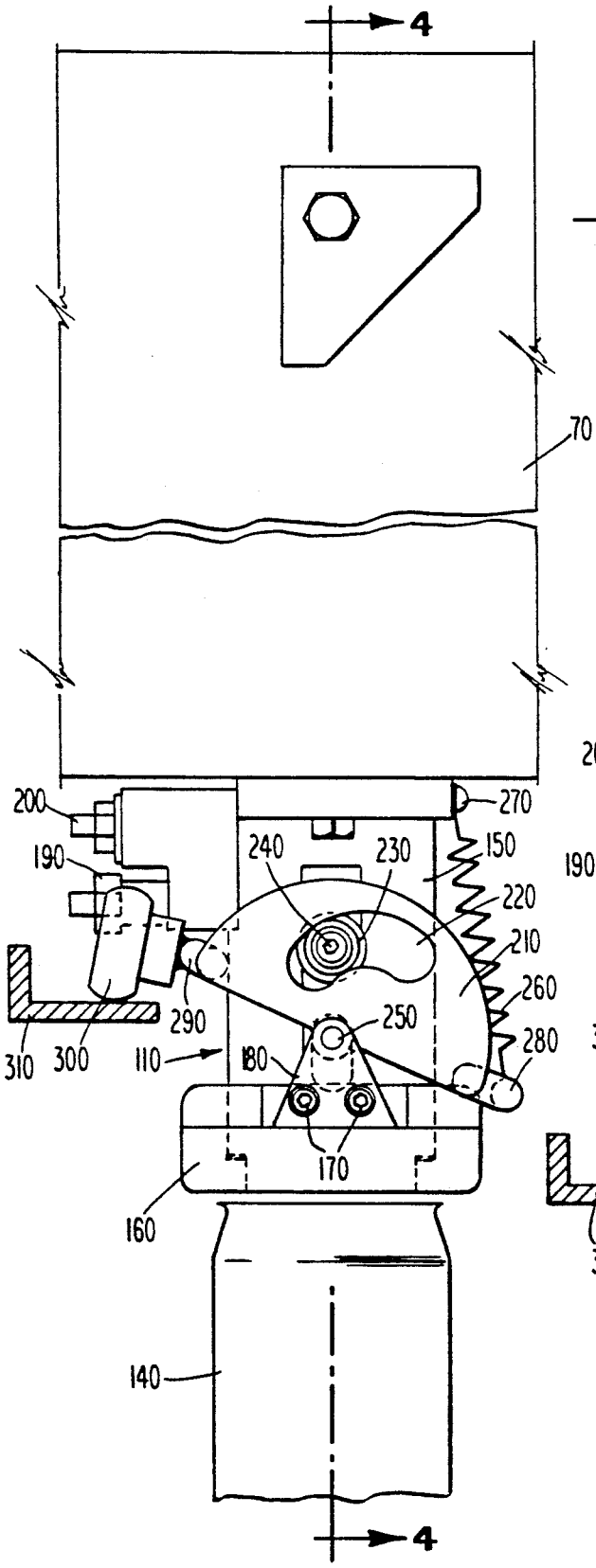
Fig. 2
Fig. 3
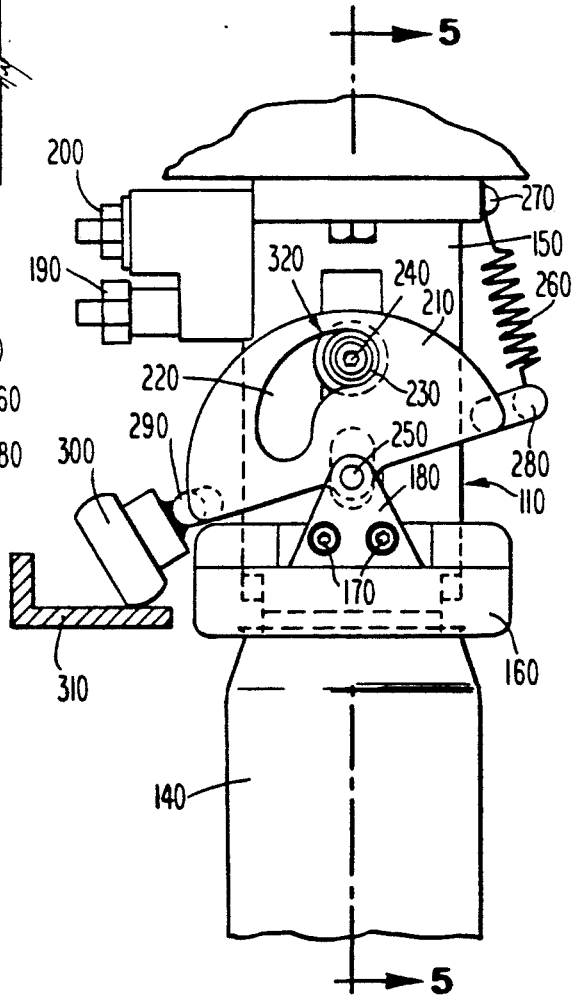

FILLING VALVE

This is a division of application Ser. No. 420,575, filed Oct. 12, 1989, now abandoned.

FIELD OF THE INVENTION

This invention relates to filling valves for use in counterpressure filling machines. More specifically, this invention relates to filling valves having a movable vent tube for counterpressure filling containers with carbonated liquids.

BACKGROUND OF THE INVENTION

The Beverage industry continually strives for machinery and methods which facilitate rapid, economical and efficient filling of containers, such as bottles or cans, with carbonated liquids. Improved machinery for filling containers with carbonated liquids and improved filling valves for rapidly and efficiently filling these containers are therefore desirable. These machines and valves must ensure that the carbonated liquid which fills the containers under pressure does not escape from the machine during filling, and that the carbonation does not escape from the liquid as the container is filled.

Methods and apparatus for filling containers with carbonated liquids have evolved into counterpressure filling machines in which the containers are first filled with a gas under pressure, for example, $CO_2$, at about 40 psi. The carbonated liquid is thereafter admitted to the containers under pressure so that the carbonated liquid does not escape. The containers are then quickly closed, thereby ensuring that the carbonation does not escape the liquid. An example of a filling valve in a carbonated liquid bottling machine is shown in U.S. Pat. No. 4,089,353, Antonelli, which is commonly assigned. The teachings of the Antonelli patent are specifically incorporated herein by reference.

In the Antonelli patent, a filling valve is shown which connects a container with a tank containing a supply of the liquid which will fill the container, and a supply of the pressurized gas for counterpressurizing the container. The filling valve is controlled by a cam outside of the tank which actuates a first valve member such that the counterpressure gas is first admitted to the container. The container is filled with the counterpressure gas until the pressures of the gas and the liquid are equal. A second valve member is then opened by the cam which allows the liquid to flow into the container under the influence of gravity. When the container is filled, the cam actuator closes the valve members and the bottle is lowered away from the valve in a sequenced operation.

In exemplary machines for filling cans employing the principles of the Antonelli patent, a plurality of filling valves are mounted to the machine on a bottom circular surface. The cans which are to be filled are carried along a conveyer to lifters which move along a path under the filling valves. Examples of such filling valves are found in U.S. Pat. No. 4,750,533, Yun, which is commonly assigned. The Yun patent teaches a filling valve for filling cans with a pressurized fluid wherein the can is lifted to the filling valve. Each can is carried to a lifter which moves the can vertically upward to the filling valve. The lifter and the can are then moved in a circular path with the filling valve as the can is filled with the carbonated liquid. After the can is filled, the lifter lowers the can away from the valve. Machines which utilize lifters are relatively complex and expensive, and require complex structures to support the lifters as they cooperate with the filling valves.

To reduce the cost and complexity of such can filling machines, machines have been developed in which the cans are not elevated toward the filling valves, but rather, remain stationary in a vertical direction while the filling valve is lowered to meet the can. Although these machines are mechanically less complicated and substantially less expensive to produce, they have a severe disadvantage due to a reduced operating speed.

The filling valves which are used in these stationary can machines generally include two concentric valve members. An outer valve member for admitting liquid into the container is provided, and an inner valve member for admitting counterpressure gas into the container is further provided. The outlet dispensing end or "vent tube" for the inner valve member must be inserted a certain distance into the container for proper operation of the filling valve. To achieve this action, the filling valve must have a relatively long stroke to meet the containers, thereby ensuring that the outlet of the vent tube is inserted the proper depth in the container and that the vent tube is lifted clear from the container after the container is filled with the carbonated liquid. The requirement of moving the filling valves along this relatively long stroke significantly slows down the overall operation of stationary container filling machines.

Examples of filling machines having movable filling valves may be found in U.S. Pat. No. 4,679,603, Rademacher et al. The Rademacher et al. patent discloses a filling valve which can be lowered into the filling position by a cam disk and a pressure spring, or which can be lowered into position by overpressure within the filling machine vessel. A centering member within the filling valve can similarly be moved into position with the container. An upwardly extending piston member forming part of the piston-cylinder unit contains a return gas tube which can move independently of the piston-cylinder unit. The piston-cylinder unit in cooperation with a double lever arm arrangement places the filling valve in the open condition to achieve complete pressure equalization. See column 1, line 58, through column 2, line 15.

The filling valves disclosed in the Rademacher et al. patent do not fulfill a long-felt need in the art for filling valves that perform fast and efficient filling of containers with carbonated liquids. The use of the double arm lever arrangement disclosed in the Rademacher et al. patent for allowing independent movement of the return gas tube with respect to the valve is cumbersome and requires complex mechanisms to actuate valve movement. These complex mechanisms are costly, and greatly add to the time it takes for the filling valve to be lowered into position over the container which will be filled with the carbonated liquids.

The filling valves described above do not satisfy a long-felt need in the art for filling valves which can efficiently and expeditiously fill a large number of filling cans in a counterpressure filling machine. Filling valves which would satisfy this need should have a shortened vent tube stroke and be movable to interface with stationary containers which will be filled with carbonated liquids.

SUMMARY OF THE INVENTION

The above mentioned long-felt needs in the art are satisfied by filling valves provided in accordance with the present invention. In accordance with this invention, filling valves for counterpressure filling containers with carbonated liquids are provided. Valve body means for conducting the carbonated liquid to the container from an external reservoir, the valve body means having an end from which the carbonated liquid is dispensed to the container is further provided. Counterpressure valve means movably mounted in the valve body means for controlling the flow of counterpressure gas to the container is also further provided. Vent tube means slidably mounted in the valve body means through the dispensing end of the valve body means for dispensing the counterpressure gas to the container, the vent tube means being slidable with respect to the valve body means from a retracted position to an extended position in the container in response to the counterpressure gas is provided. Further, pressure relief means interfaced through the valve body means for venting gas from the valve after the liquid has filled the container whereby movement of the vent tube means from the extended position to the retracted position is substantially unimpeded is provided in accordance with the invention.

In further preferred embodiments, housing means movably mounted with respect to the valve body means for securing the container to valve during filling is provided. Actuating means coupled thereto for moving the housing means relative to valve body means onto the container is further provided.

Methods of dispensing carbonated liquids from a counterpressure filling machine to a container are provided in accordance with the present invention. The methods comprise the steps of moving the container in proximity to a valve in the counterpressure filling machine, moving a vent tube into a container from the valve, filling the container with counterpressure gas through the vent tube, filling the container with carbonated liquid, thereby displacing a substantial portion of the counterpressure gas from the container through the vent tube, venting remaining counterpressure gas from the container, and moving the vent tube from the container without substantial pressure impedance due to the counterpressure gas.

BRIEF DESCRIPTION OF THE DRAWINGS

FIG. 2 is a side elevation view of a filling valve provided in accordance with the present invention.

FIG. 3 is a side elevation view of a filling valve provided in accordance with the present invention in engagement with a can.

DETAILED DESCRIPTION PREFERRED EMBODIMENTS

Figure 1:
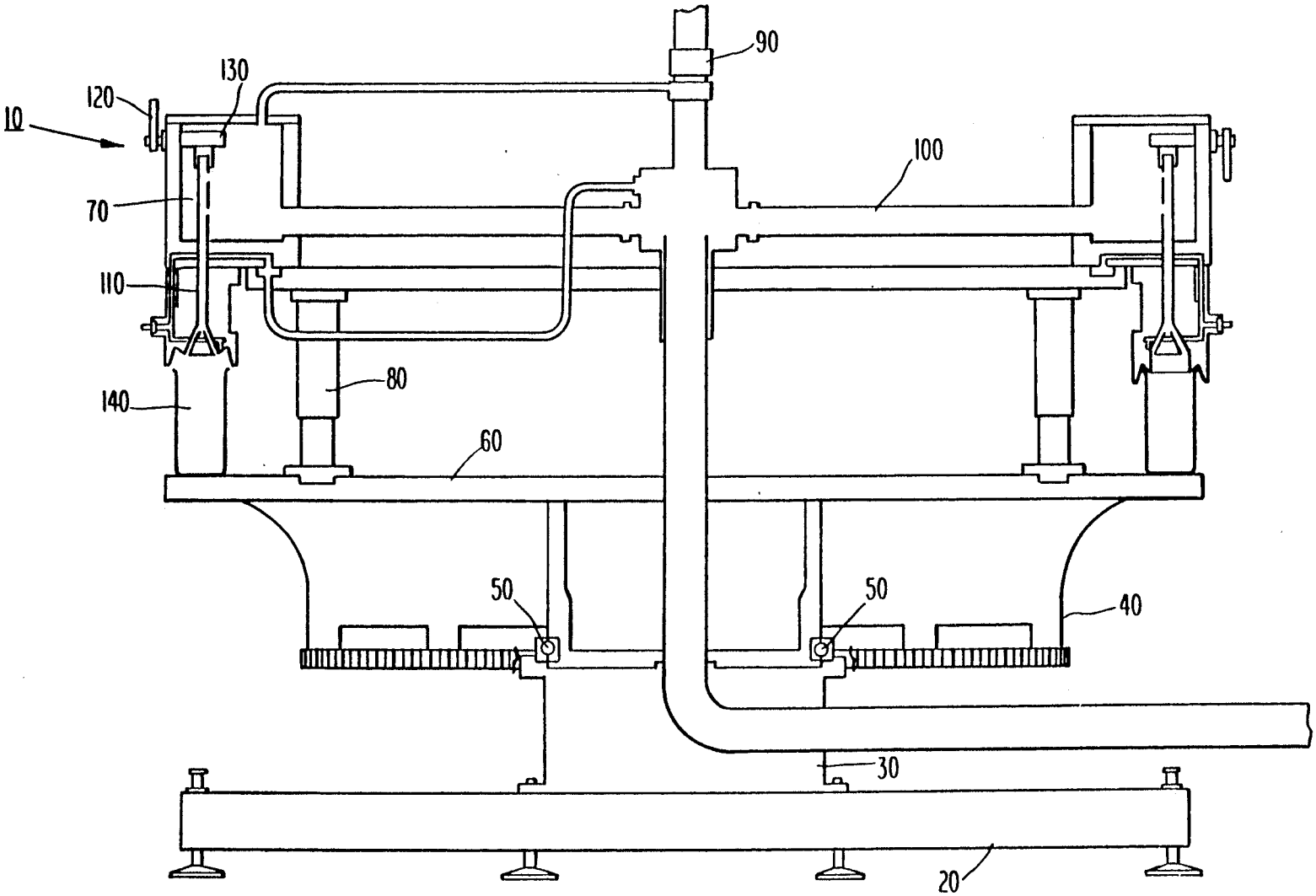
FIG. 1 is a schematic of a counterpressure filling machine utilizing filling valves provided in accordance with the present invention.

Referring now to the drawings wherein like reference numerals refer to like elements, FIG. 1 is a schematic drawing of a counterpressure filling machine shown generally at 10. The entire machine is supported by base 20, which is mounted or rests on a conventional footing. A drive motor 30 having a main drive gear assembly 40 in rotational engagement with drive motor 30 is mounted to base 20. Main drive gear assembly 40 is supported by base 20 through main bearings 50. Cylindrical support casting 60 is mounted to main drive gear assembly 40.

Reservoir 70 is generally cylindrical in shape and is supported by main drive gear assembly 40. Reservoir 70 is rotatable by main drive gear assembly 40 and contains carbonated liquid and counterpressure gas used in filling containers. Reservoir 70 is mounted to cylindrical support casting 60 by vertical support member 80 and is further centrally disposed about and in fluid communication with counterpressure gas feed hub 90, and carbonated liquid feed line 100 respectively. Due to this arrangement, a constant supply of counterpressure gas and carbonated liquid may be supplied to reservoir 70 even as it rotates.

Depending externally from and extending into reservoir 70 is a filling valve 110 provided in accordance with the present invention. A valve actuating arm 120 is connected to a cam 130 contained within the reservoir and in contact with valve 110. Valve actuating arm 120 is used to dispose cam 130 with respect to valve 110 in various operating positions as valve 110 fills a container 140 with carbonated liquid. The container may be a bottle, can, or any other receptacle appropriate for holding carbonated liquids.

In operation of previous filling machines, containers are repeatedly engaged and disengaged with stationary filling valves by a carousel apparatus which moves the containers to the filling valves. In accordance with the present invention, such a carousel apparatus with its associated lifter mechanisms may be eliminated, and filling valve 110 is lowered onto stationary can 140 in order to fill the can with carbonated liquids.

Referring to FIG. 2, filling valve 110 is shown above a stationary can 140. Filling valve 110 is in fluid communication with reservoir 70. The filling valve has a generally valve body 150 having an end from which the carbonated liquid is dispensed to a container and which extends downward onto a housing 160, herein denoted as a "bell."

Bell 160 is mounted to valve body 150 by machine screws 170 through bracket 180. Shift valve 190 is move 190 is mounted to valve body 150 and, in typical operation of a counterpressure filling machine, is actuated by a snift cam to release counterpressure gas from the top of can 140 after the can has been filled with the carbonated liquid. Additionally, a clean in place valve 200 is interfaced with valve body 150 and is actuated to allow cleaning fluid to course through the valve and accomplish the cleaning operation which kills bacteria in the filling machine.

Bell 160 is slidably mounted around valve body 150. A valve actuating cam 210 is pivotally mounted to bracket 180 which joins bell 160 to valve body 150. An arcuate slot 220 is integrally formed in actuating cam 210. A cam roller 230 is housed within arcuate slot 220 and is mounted to valve body 150. Cam roller 230 rides within arcuate slot 220 as actuating cam 210 pivots around bracket 180. Cam roller 230 is rotatably mounted to valve body 150 by a cam roller shaft 240 which extends through valve body 150 to the opposite side of the valve body wherein an identical actuating cam and cam roller are mounted. A second cam roller shaft 250 is disposed through actuating cam 210 and bracket 180 to further secure cam 210 to valve body 150, and to mechanically join cam 210 to bell 160, which is longitudinally, slidably mounted around the bottom of valve body 150.

A resilient spring 260 is secured at 270 to the top of valve body 150. Resilient spring 260 is also securely mounted on a back arm 280 which is integrally formed on actuating cam 210. In FIG. 2, resilient spring 260 is shown in the extended position, indicating that bell 160 is disengaged from can 140.

In preferred embodiments, actuating cam 210 is fixedly secured on a second arm 290 to a roller 300. Roller 300 rests on cam follower surface 310. Cam follower surface 310 will generally have a sloping profile which varies along the periphery of the filling machine in accordance with the position that the filling valve is intended to take with respect to the stationary cans at the various filling positions on the machine. Since cam follower surface 310 is sloped, roller 300 actuates cam 210 and drives cam 210 along cam roller 230 in arcuate slot 220 with respect to valve body 150.

As cam 210 changes its position due to the movement of the arcuate slot 220 along cam roller 230, bell 160 slidably moves longitudinally around valve body 150 and is put in engagement with can 140. In this fashion, actuating cam 210 forces bell 160 into engagement with can 140 as roller 300 rolls along cam follower surface 310, thereby causing cam roller 230 to move in engagement with arcuate slot 220.

Referring now to FIG. 3, valve 110 is shown wherein bell 160 is engaging can 140. Roller 300 has rolled to a position on cam follower surface 310 such that actuating cam 210 has pivoted on shafts 240 and 250, thereby causing cam roller 230 to migrate in arcuate slot 220 to the opposite end of the arcuate slot. In this position, resilient spring 260 is at its natural length, and bracket 180 mounted to bell 160 through bolts 170 has forced bell 160 into engagement with the top of can 140.

In still further preferred embodiments, arcuate slot 220 is fashioned so as to contain an unstable point of equilibrium 320 for cam roller 230. When cam roller 230 falls on unstable equilibrium point 320 as roller 300 forces actuating cam 210 to move, cam roller 230 is forced into the position shown in FIG. 3, thereby forcibly engaging bell 160 with can 140. In this manner, arcuate slot 220 having unstable equilibrium point 320 is assured of fixedly securing bell 160 to can 140 during the filling process.

Unstable equilibrium point 320 within arcuate 220 is particularly necessary for filling valves provided in accordance with this invention which utilize sealing rubbers located within bell 160. Sealing rubbers for use in counterpressure filling machines and filling valves are taught in U.S. Pat. No. 4,750,533, Yun which is specifically incorporated herein by reference. Thus, unstable equilibrium point 320, which, in preferred embodiments, is located substantially around the center of arcuate slot 220, ensures that cam roller 230 is forced into the position within arcuate slot 220 that causes actuating cam 210 to securedly fix bell 160 onto the top of can 140 during the counterpressure filling process.

Figure 4:
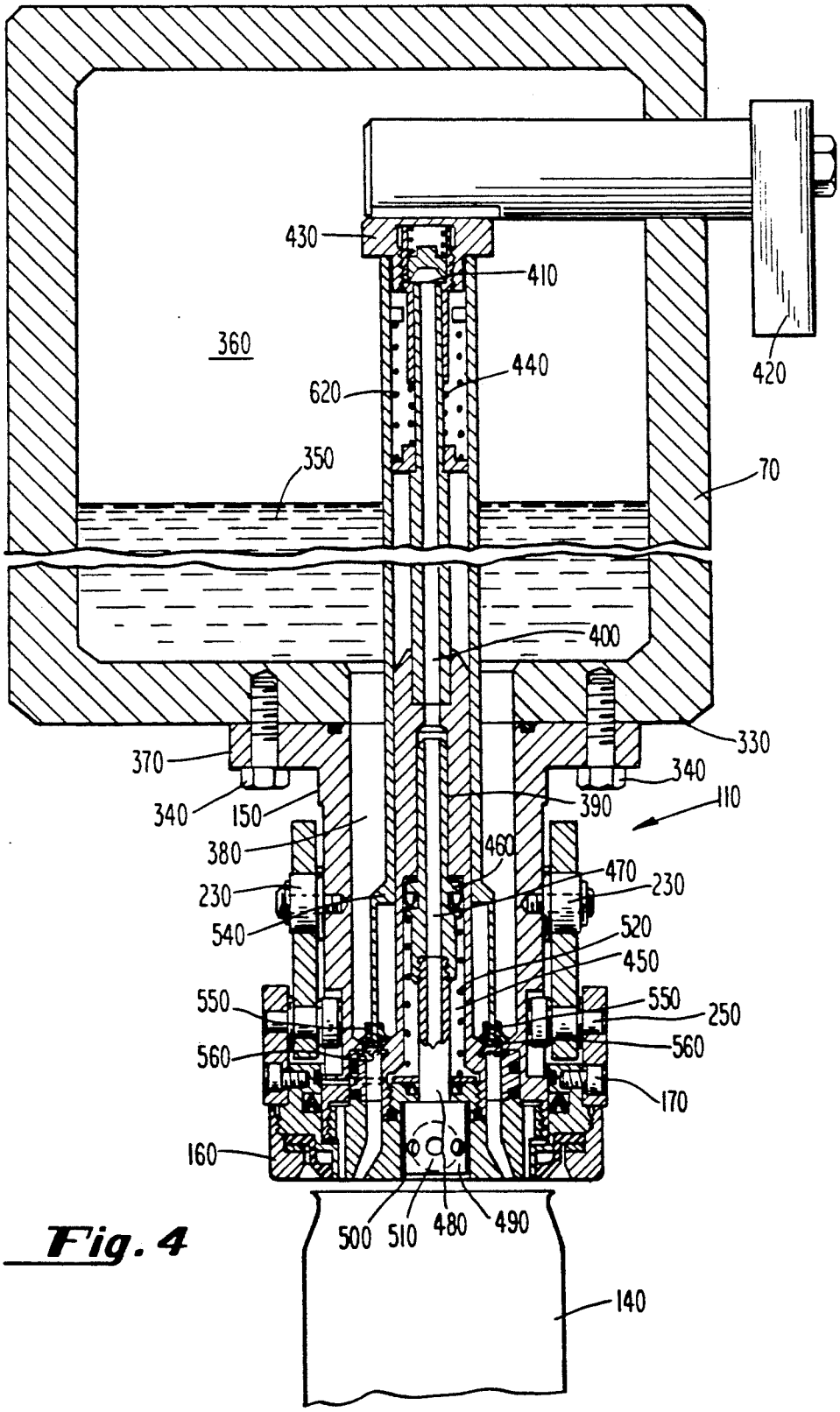
FIG. 4 is a cross-sectional view of a filling valve taken along the 4—4 line of FIG. 1.

Referring to FIG. 4, a filling valve provided in accordance with this invention is fixedly mounted through flange 370 to the bottom reservoir 70 by bolts 340. Reservoir 70 contains carbonated liquid 350 which is dispensed to can 140 during operation of the filling machine. A counterpressure gas 360 at elevated pressure, typically nitrogen or carbon dioxide at 40–45 psi, is above liquid 350 in reservoir 70. A liquid passage 380 extends longitudinally through a portion of valve body 150 from the top end of valve body 150 and is in communication with liquid 350 in reservoir 70.

A tube 390 extends upwardly through the liquid passage 380 into reservoir 70 to a point above the level of liquid 350. The tube 390 has a passage 400 extending longitudinally therethrough terminating at its upper end in first valve member 410 which is constructed, in preferred embodiments, to permit the flow of counterpressure gas 360 from reservoir 70 into passage 400. The construction and operation of similar filling valves is described in the Antonelli patent.

Valve member 410 is actuated by a cam 420 which directly acts on a valve cap 430. When valve cap 430 is released by cam 420, a counterpressure spring 440 forces counterpressure valve 410 upward, thereby allowing counterpressure gas 360 to flow into and through longitudinal passage 400. The bottom end of tube 390 opens into a cylinder 450 which contains a longitudinally slidable piston 460 having a longitudinal passage 470 in substantial alignment with longitudinal passage 400 of tube 390. A vent tube 480 is secured to the bottom of piston 460 and extends longitudinally from the bottom of the piston such that the bottom of the vent tube 480 is in substantial alignment with the passage 470 of piston 460.

Vent tube 480 is slidably mounted in valve body 150 through the end of valve body 150 for dispensing the counterpressure gas into the container. In preferred embodiments, vent tube 480 is longitudinally slidable with respect to valve body 150 from a retracted position to an extended position in the container. Similarly, vent tube 480 is slidable back into the retracted position in valve body 150 from the extended position in the container.

Vent tube 480 is adapted to receive a "checkball" cage 490 to regulate the flow of the carbonated liquid to the container on its bottom end. Checkball cage 490 is seated in a recess 500 at the bottom end of the valve body 150. A ball 510 is located within the checkball cage 490. A resilient spring 520 is compressed between the piston 460 and the bottom end of the cylinder at 530. Resilient spring 520 urges piston 460 in an upward direction towards reservoir 470 to seat the checkball cage 490 in a recess 500.

A second valve member 540 is located within valve body passage 380 surrounding valve tube 450. Located on the bottom of the second valve member 540 is valve seat 550 which is seated on openings 560 that extend through the bottom portion of valve body 150 to the end of bell 160. Valve seat 550 is held against openings 560 by cam 420. However, spring 620 between valve tube 390 and second valve member 540 tends to lift valve seat 550 away from openings 560 when permitted by cam 420.

Figure 5:
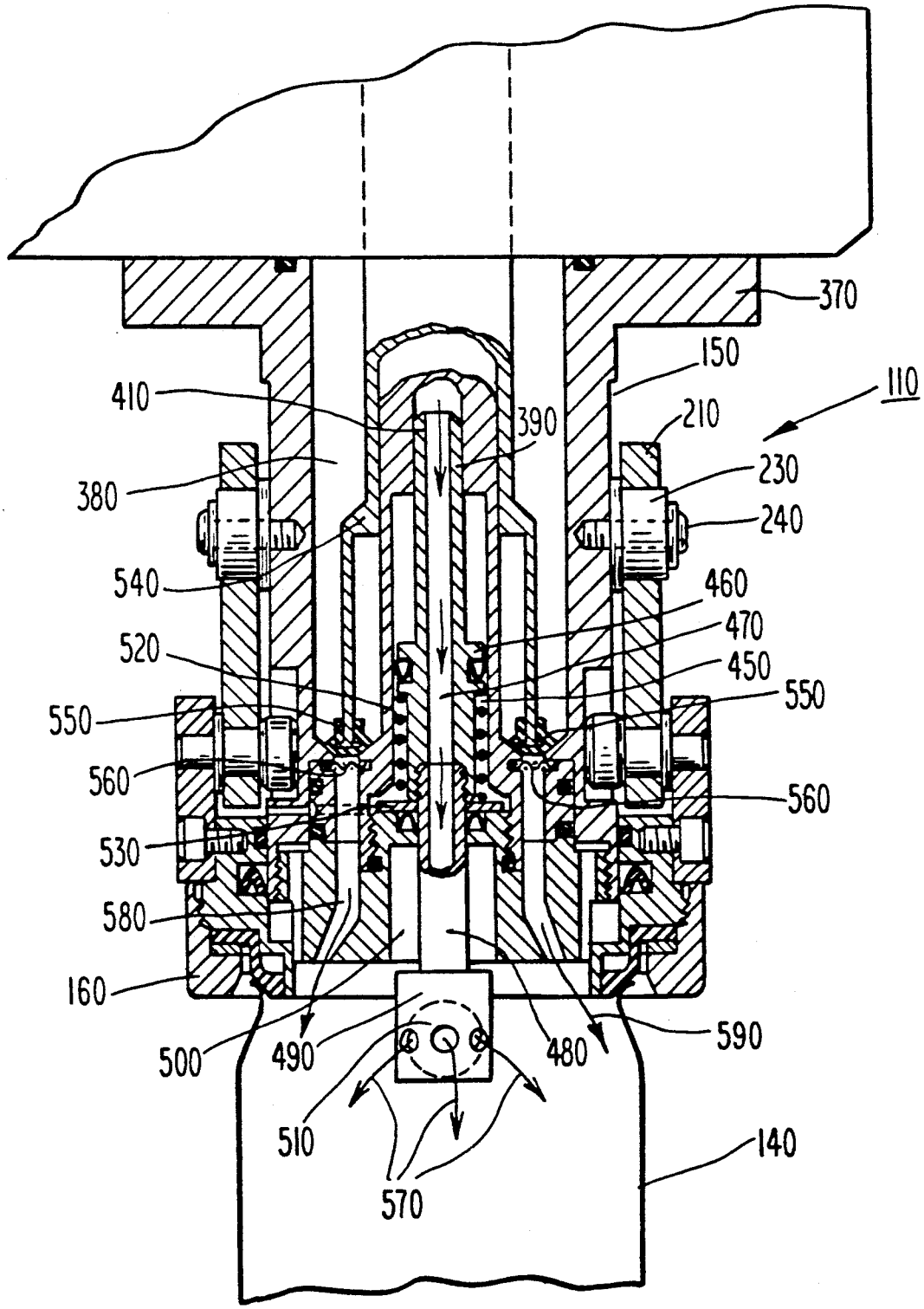
FIG. 5 is a cross-sectional view of a filling valve taken along the 5—5 line of FIG. 3.

Referring now to FIG. 5, can 140 is carried by conveyor to a position in proximity under filling valve 110 in a counterpressure filling machine. In this fashion, bell 160 is lowered onto can 140 which remains stationary. Cam 420 then operates the valve member 410 to allow counterpressure gas to flow through the passage 400 into cylinder 450. The counterpressure gas presses on piston 460, causing it to move downwardly in the cylinder 450. The counterpressure gas overcomes the resiliency of spring 520 and thus forces vent tube 480 and checkball cage 490 into the can 140 in the extended position, as indicated by the arrows 570 in FIG. 5.

Figure 6:
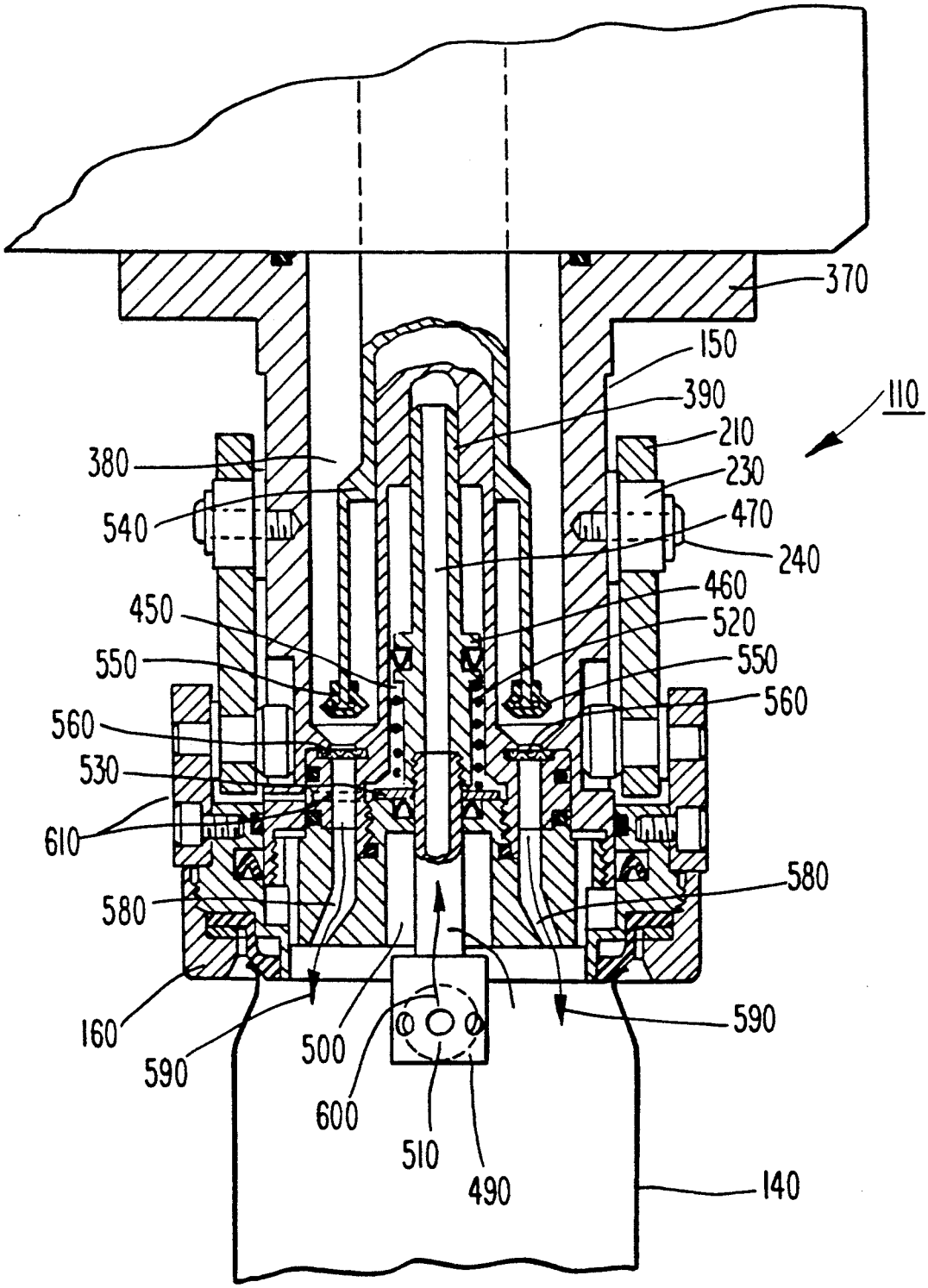
FIG. 6 is a cross-sectional view of a filling valve engaged with a can as the can is being filled with carbonated liquid.

Referring to FIG. 6, when can 140 is filled with counterpressure gas, spring 520 pushes the second valve member 540 up, thereby allowing carbonated liquid to flow from reservoir 70 through passage 470 to the openings 560 and down inlet gaps 580 into can 140, as indicated by arrows 590 in FIG. 6. The liquid entering the can 140 causes the counterpressure gas to be displaced upwardly out of the can as indicated by arrows 600 in FIG. 6.

The carbonated liquid fills can 140 until it reaches the level of ball 510 in checkball cage 490. As the liquid reaches the level of ball 510, the liquid lifts the ball upwardly until it closes the valve stem 480 and stops the flow of counterpressure gas out of can 140. This in turn stops the flow of liquid of liquid into can 140. Since the gas and the liquid are in the same reservoir 70 their pressures are equal and hence, liquid flow stops when gas can no longer escape from can 140. This method of shutting off liquid flow is accurate and efficient and is discussed in detail in the Antonelli patent.

At this point, the snift valve 190 is actuated allowing the counterpressure gas in the head space of can 140 to be vented to the atmosphere through valve body 150. Since the counterpressure gas has been removed from valve body 150, spring 450 urges piston 460 to move upward into the valve body, thereby removing checkball cage 490 and vent tube 480 out of can 140 longitudinally back into the valve in the retracted position. During this procedure, bell 160 stays stationary and fixed to the top of can 140 since, in preferred embodiments, vent tube 480 is movable with respect to bell 160 within the valve body 150.

However, as piston 460 and vent tube 480 are urged upward into valve body 150, any remaining counterpressure gas and air is displaced upward and tends to overcome the resiliency of spring 520, thereby impeding the migration of piston 460 and vent tube 480 back up into valve body 150 after the liquid has filled the can. In preferred embodiments, to overcome the undesirable effects of this trapped gas and air, pressure relief means 610 is interfaced through valve body 150 and passage 380. In further preferred embodiments, pressure relief means 610 is a passage interfaced through the valve body means. Passage 610 is opened to the atmosphere and allows the displaced gas and air which impedes migration of piston 460 up into valve 110 to escape valve body 150 allowing vent tube 480 substantially unrestricted traverse to the retracted position after can 140 has been filled with the carbonated liquid.

In still further preferred embodiments, vent tube 480 moves separately from bell 160 into, and out of can 140. Therefore, it is only necessary for bell 160 to move a short distance, typically about ¼ inch, in order to make sealing contact with can 140. Actuating cam 210 need thus only move bell 160 a very short distance, which alleviates the necessity for complex mechanical components to bring valve 110 into sealing contact with can 140 so that can 140 can be filled with carbonated liquids. Furthermore, since vent tube 480 moves separately from bell 160, the remaining distance which checkball cage 490 must traverse to achieve the proper depth in can 140 to fill the can is similarly minimized. This further alleviates the need for complex machinery to accurately and quickly place vent tube 480 within the can so that the can may be filled.

The vent tube stroke of filling valves provided in accordance with this invention, and the distance which bell 160 must move is much shorter than similar strokes of other filling machine valves in which a filling valve moves in contact with a stationary can. By providing a shortened stroke, faster operation of the filling machine is achieved. This greatly increases the economy and efficiency of counterpressure filling machines provided in accordance with this invention, and solves a long-felt need in the art for counterpressure filling machines and filling valves which can fill containers with carbonated liquids at high speed. Additionally, since only bell 160 moves to make sealing contact with can 140, only a small amount of mechanical structure must be moved, thereby aiding and further increasing the speed of the filling machine. Filling valves provided in accordance with the present invention thus solve a long-felt need in the art for filling valves which have a shortened stroke to permit faster operation of the counterpressure filling machines.

There have thus been described certain preferred embodiments of methods and apparatus for filling containers with carbonated liquids. While preferred embodiments have been described, it will be appreciated by those with skill in the art that modifications are within the true spirit and scope of the invention. The appended claims are intended to cover all such modifications.

What is claimed is:

1. A method of dispensing carbonated liquids from a counterpressure filling machine to a container comprising the steps of:

moving the container in proximity to a counterpressure valve in the counterpressure filling machine;

operating a gas valve to permit counterpressure gas to flow into a cylinder associated with a piston connected to a vent tube, thereby increasing the pressure in the cylinder and displacing the piston to permit counterpressure gas to flow into the vent tube and thereby moving the vent tube into the container from the counterpressure valve;

filling the container with counterpressure gas through the vent tube until a pressure equilibrium is reached, whereby a liquid valve is opened by the action of a spring to permit carbonated liquid to flow into the container;

filling the container with the carbonated liquid, thereby displacing a substantial portion of the counterpressure gas from the container through the vent tube;

closing the liquid valve and sealing the vent tube;

venting remaining counterpressure gas from the container;

moving the vent tube from the container; and relieving pressure impedance in the cylinder developed by the migration of the piston in the vent tube.

2. The method recited in claim 1 wherein as th moves out of the container, the vent tube displaces counterpressure gas through a passage in the valve to atmosphere.

3. The method of claim 1, wherein the step of venting remaining counterpressure gas comprises opening a shift valve.

4. The method of claim 1, wherein the step of relieving pressure impedance includes the step of opening a passage between the atmosphere and a space above the piston.

* * * * *

UNITED STATES PATENT AND TRADEMARK OFFICE

CERTIFICATE OF CORRECTION

PATENT NO. : 5,150,740

DATED : September 29, 1992

INVENTOR(S) : Chung J. Yun

It is certified that error appears in the above-identified patent and that said Letters Patent is hereby corrected as shown below:

Column 4, lines 39-40 between "generally" and "valve" insert --cylindrical--.

Column 8, claim 2, line 57, delete "th" and insert --the vent tube--.

Signed and Sealed this

Twenty-sixth Day of October, 1993

*Attest:*

Bruce Lehman

BRUCE LEHMAN

*Attesting Officer*

*Commissioner of Patents and Trademarks*